US007630675B2

(12) United States Patent
Tateishi et al.

(10) Patent No.: US 7,630,675 B2
(45) Date of Patent: Dec. 8, 2009

(54) FUSER UNIT WITH CLEANING MECHANISM AND IMAGE FORMING APPARATUS HAVING THE SAME

(75) Inventors: Yoshinobu Tateishi, Nara (JP); Yasunori Minakuchi, Nara (JP); Toshiya Mikita, Osaka (JP); Toyoaki Nanba, Osaka (JP); Yoshiyuki Nagai, Oita (JP); Hiroshi Nakatani, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 165 days.

(21) Appl. No.: 11/756,667

(22) Filed: Jun. 1, 2007

(65) Prior Publication Data

US 2007/0280753 A1 Dec. 6, 2007

(30) Foreign Application Priority Data

Jun. 5, 2006 (JP) ..... 2006-156452
Sep. 8, 2006 (JP) ..... 2006-244274

(51) Int. Cl.
*G03G 15/20* (2006.01)

(52) U.S. Cl. ..... 399/327

(58) Field of Classification Search ..... 399/326, 399/327, 352
See application file for complete search history.

(56) References Cited

U.S. PATENT DOCUMENTS 3,380,355 A * 4/1968 Eichorn ..... 399/352
4,939,552 A * 7/1990 Nakanishi ..... 399/352
6,305,636 B1 * 10/2001 Satoh et al. ..... 242/538.2
6,487,381 B1 * 11/2002 Ishizuka et al. ..... 399/67
2005/0042003 A1 * 2/2005 Matsumoto ..... 399/327

FOREIGN PATENT DOCUMENTS

| | | |
|---|---|---|
| JP | 08-185074 | 7/1996 |
| JP | 2001-188436 | 7/2001 |
| JP | 2003-098887 | 4/2003 |
| JP | 2003-107952 | 4/2003 |
| JP | 2003-255746 | 9/2003 |
| JP | 2003345160 A * | 12/2003 |
| JP | 2004-037556 | 2/2004 |

* cited by examiner

*Primary Examiner*—David M Gray
*Assistant Examiner*—Gregory H Curran
(74) *Attorney, Agent, or Firm*—Renner, Otto, Boisselle & Sklar, LLP

(57) ABSTRACT

A fuser unit with a cleaning mechanism, including: a set of a heat roller and a pressure roller for sandwiching a recording sheet while heating the recording sheet by the heat roller; a feed roller for feeding a band-shaped cleaning member which is windable; a press roller for pressing the fed cleaning member against a surface of the heat roller or the pressure roller; a wind roller for winding the cleaning member which is pressed by the press roller; and a first reverse rotation preventing mechanism for preventing rotation of the press roller from rotating in the opposite direction to the winding direction of the cleaning member.

9 Claims, 10 Drawing Sheets

FUSER UNIT WITH CLEANING MECHANISM AND IMAGE FORMING APPARATUS HAVING THE SAME

CROSS-REFERENCE TO RELATED APPLICATION

This application is related to Japanese patent application Nos. 2006-156452 and 2006-244274 which are filed on Sep. 8, 2006 and Dec. 26, 2006 respectively whose priorities are claimed under 35 USC §119, the disclosure of which are incorporated by reference in its entirety.

BACKGROUND OF THE INVENTION

1. Field of the Invention

The present invention relates to a fuser unit with a cleaning mechanism and an image forming apparatus having the same.

2. Description of the Related Art

In recent years, the printing process speed of an image forming apparatus is increasing. As the printing process speed increases, improvement in the capability of removing residual toner (cleaning capability) of a cleaning mechanism of a fuser roller in a fuser unit is required. The fuser unit performs fusing with a heat roller and a pressure roller rotating while in contact with each other with pressure. The cleaning mechanism is a mechanism for cleaning the heat roller and/or the pressure roller. Hereinbelow, the heat roller and/or the pressure roller will be described as fuser rollers. When the printing process speed increases, an amount per unit time of toner residing on the fuser rollers increases. The toner residing on a surface of the fuser rollers or the toner once removed remains in a cleaning unit. A problem such that the toner hardened in the non-conductive state or a power saving mode damages the fuser rollers in current-carrying operation after that becomes obvious. That is why improvement in the cleaning capability is required.

Therefore, in place of the conventional cleaning mechanism (a fuser cleaning mechanism using felt or roller), a "web cleaning system" is often used (refer to, for example, Japanese Unexamined Patent Application Publication No. 2003-107952). The web cleaning system is a mechanism using a web of sheet in a band shape as a cleaning member and winding the web sheet intermittently so that the sheet in a fresh state comes into contact with the fuser roller. The cleaning mechanism of the web cleaning system can clean the fuser rollers until the end of the web sheet without largely deteriorating the initial cleaning capability.

The direction of winding the web sheet after cleaning has to be opposite to the movement of the peripheral face of the fuser roller for the following reasons. The residual toner on the fuser roller is removed at the tip of a nip part in which the web sheet comes into contact with the surface of the fuser roller, that is, on the upstream side in the direction of movement of the peripheral face of the fuser roller. The removed toner is taken by the web sheet on the upstream side in the nip part. The web sheet is wound in the direction in which the removed toner does not pass through the nip portion, that is, the direction opposite to the direction in which the peripheral face of the fuser roller moves. If the web sheet is wound in the forward direction, the toner taken by the web sheet passes through the nip portion and returns to the fuser roller side during the passage, and it is feared that the surface of the roller becomes dirty.

In a low temperature state, there is the possibility that hardened toner damages the surface of the roller. Further, when the web sheet partially taking toner and whose thickness becomes nonuniform passes through the nip portion, the press contact force to the fuser roller of the web sheet becomes nonuniform. As a result, the frictional force received from the fuser roller also becomes nonuniform, and it causes a wrinkle in the web sheet. When a wrinkle occurs in the web sheet, the contact to the surface of the fuser roller becomes nonuniform, and it causes poor cleaning. When a state where a wrinkle occurs continuously, the web sheet may be broken.

FIG. 8 is a diagram schematically showing the configuration of a fuser cleaning mechanism 201 of a conventional web cleaning system. FIG. 8 shows an example of the case where the fuser cleaning mechanism 201 is provided for a heat roller 202.

The fuser cleaning mechanism 201 includes a web sheet 203 as a band-shaped cleaning member for cleaning a surface, a press roller 204 provided for pressing the web sheet 203 on a surface of the heat roller 202, a feed roller 205 used in a state where the web sheet 203 is wound around its peripheral face and sequentially feeding the wound web sheet 203 from its tip, and a wind roller 206 for winding the web sheet 203 fed from the feed roller 205 and cleaned the surface of the heat roller 201.

When the heat roller 202 rotates in the rotative direction shown by an arrow 207, toner 208*a* adhered in a fused state on the peripheral face of the heat roller 202 in a slide contact part with the web sheet 203 in a stationary state is removed. The removed toner 208*a* is stored on the upstream side of the contact part between the heat roller 202 and the press roller 206 in an almost fused state. Toner 208*b* is the toner stored as described above and is stored in a gap formed by the web sheet 203 and the surface of the heat roller 202.

When the toner 208*b* accumulated in the gap reaches to a certain amount, the wind roller 205 rotates in the direction of an arrow 209 and winds the web sheet 203 only by predetermined length. The accumulated toner 208*b* is therefore detached from the surface of the heat roller 202 in a state where the toner 208*b* is adhered to the web sheet 203.

The web sheet which comes into contact with the fuser roller receives a force in the direction along the travel of the peripheral face by the friction with the peripheral face of the fuser roller. The force is in the direction opposite to the direction of winding the web sheet. As the printing process speed increases, the peripheral speed of the fuser roller also increases. As a result, the frictional force received from the fuser roller by the web sheet is also enhanced. Hitherto, by the tension from the wind roller for winding the web sheet, backward travel of the web sheet is prevented. However, as the printing process speed increases, in some cases, the tension becomes insufficient. Due to elongation of the web sheet, the toner accumulated on the upstream side of the nip portion enters the nip portion. When the toner enters the nip portion, it causes dirt or damage in the fuser roller and a wrinkle in the web sheet. To prevent such problems, for example, it is necessary to excessively wind the web sheet in consideration of the "elongation".

On the other hand, the web sheet as a cleaning member has to be resistant to the heat of the fuser unit and pressure-contact with the roller surface to be cleaned. Preferably, the web sheet is porous to absorb and hold residual toner. Usually, the web sheet is wound only by length according to the use of a predetermined period and loaded in a fuser unit in a state where the web sheet can be fed. The web sheet has to be thin so that it can be housed in the fuser unit. A member suitable for such a use is not common but special and expensive. It is therefore preferable that the web sheet be finely wound in order to avoid wasteful use. In other words, it is preferable to wind the web sheet little by little while maintaining the cleaning capability so as to save the web sheet. From this viewpoint, it is unpreferable to wind the web sheet excessively.

Consequently, a mechanism for preventing backward travel of the web sheet without wasting the web sheet is in demand.

In the following cases, it is preferable to prevent the travel of the web sheet irrespective of the peripheral speed of the fuser roller. When paper jam occurs in a state where a sheet to be conveyed is sandwiched between the heat roller and a pressure roller in a fixing unit, the ejection direction varies according to the state where the sheet resides. In the case of removing the sheet in a state where a most part resides on the upstream side (transfer side) of the fuser roller, usually, the operator pulls the sheet to the transfer side. On the other hand, in the case of removing the sheet in a state where a most part resides on the downstream side (paper ejecting part side) of the fuser roller, the operator pulls the sheet to the paper ejection side. When the sheet sandwiched in the nip portion is pulled out, the fuser roller rotates along the direction of pulling the sheet. As the fuser roller rotates, a force also acts on the web sheet which is pressure-contact with the fuser roller. When the web sheet moves in the case where the sheet is pulled to the paper ejection side, toner absorbed by the web sheet at the tip of the nip portion enters the nip portion. When the web sheet moves in the case where the sheet is pulled to the transfer side, the web sheet is fed uselessly.

A mechanism for preventing travel of the web sheet at the time of removing the paper jam in the fuser unit is in demand.

SUMMARY OF THE INVENTION

The present invention has been achieved in consideration of the circumstances and provides a mechanism capable of preventing backward travel of a web sheet accompanying rotation of a fuser roller so that it can be prevented from becoming dirty. Another object of the invention is to provide a mechanism capable of preventing the travel of a web sheet at the time of removing a paper jam in a fixing unit.

To solve the problems, the present invention provides a fuser unit with a cleaning mechanism, including: a set of a heat roller and a pressure roller for sandwiching a recording sheet while heating the recording sheet by the heat roller; a feed roller for feeding a band-shaped cleaning member which is windable; a press roller for pressing the fed cleaning member against a surface of the heat roller or the pressure roller; a wind roller for winding the cleaning member which is pressed by the press roller; and a first reverse rotation preventing mechanism for preventing rotation of the press roller from rotating in the opposite direction to the winding direction of the cleaning member.

According to another aspect of the invention, the present invention provides an image forming apparatus having the fuser unit.

The fuser unit of the invention has the first reverse rotation preventing mechanism for preventing rotation of the press roller from rotating in the opposite direction to the winding direction of the cleaning member. Consequently, when the fuser roller rotates or a jammed sheet is removed, a web sheet can be prevented from traveling in the opposite direction to the winding direction of the web sheet. Therefore, it becomes unnecessary to wind the web sheet excessively in consideration of the backward travel, so that the web sheet can be used effectively. The cleaning capability can be maintained without burden of extra cost on the user. At the time of removing a jammed sheet, a surface of the fuser roller can be prevented from becoming dirty or damaged due to backward travel of the web sheet. In addition, occurrence of a wrinkle causing poor cleaning and breakage of the web sheet can be prevented. In other words, by preventing the backward travel of the web sheet, deterioration in the printing quality can be prevented.

To clean a surface of the heat roller, a cleaning mechanism may be provided. To clean a surface of the press roller, a cleaning mechanism may be provided. To clean both of the heat roller and the press roller, a cleaning mechanism may be provided for each of the heat roller and the press roller.

DETAILED DESCRIPTION OF THE PREFERRED EMBODIMENTS

Regarding the fuser unit of the present invention, it may further include a second reverse rotation preventing mechanism for preventing rotation of the wind roller from rotating in the opposite direction to the winding direction of the cleaning member.

Further, the feed roller may further include a rotation preventing mechanism, wherein the feed roller may feed the cleaning member intermittently, and the rotation preventing mechanism may include a disengaging mechanism to prevent the feed roller from rotating in the feeding direction when the cleaning member is not wound, and to allow the feed roller to rotate in the feeding direction when the cleaning member is wound.

The first reverse rotation preventing mechanism may be a ratchet mechanism including a ratchet gear which is directly or indirectly coupled to a shaft of the press roller.

Alternately, the first reverse rotation preventing mechanism may be a one-way clutch which is directly or indirectly coupled to the shaft of the press roller.

Further, the second reverse rotation preventing mechanism may be a ratchet mechanism including a ratchet gear which is directly or indirectly coupled to a shaft of the wind roller.

Alternately, the second reverse rotation preventing mechanism may be a one-way clutch disposed between the wind roller and a drive source thereof.

Moreover, the rotation preventing mechanism may be a disengageable ratchet mechanism including a ratchet gear which is directly or indirectly coupled to a shaft of the feed roller, a nail member which can engage with the gear, and a disengaging mechanism for engaging/disengaging the nail member with/from the ratchet gear.

Further, the disengaging mechanism may include biasing means for biasing the nail member so that it engages with the ratchet gear, and nail member driving means for making the nail member apart from the ratchet gear against biasing by the biasing means, and the nail member driving means drives the nail member to enable the wind roller to rotate in the winding direction while the cleaning member is wound.

Alternately, the rotation preventing mechanism is a one-way clutch disposed between the feed roller and a drive source thereof.

The present invention will be described in detail hereinbelow with reference to the drawings. From the following description, the invention will be understood more specifically. The following description is to be considered in all aspects as illustrative and not restrictive.

Configuration of Fuser Unit

Figure 1:
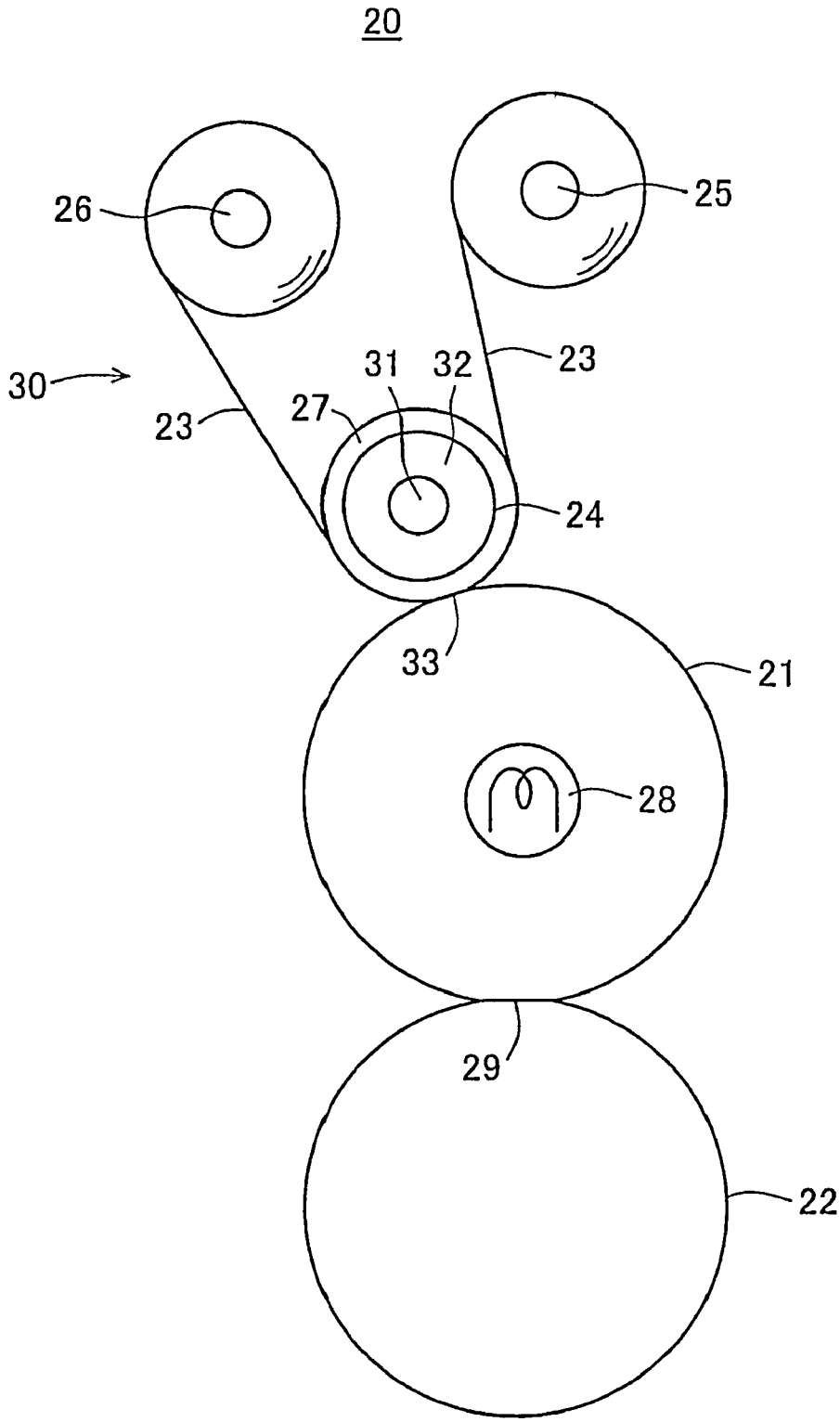
FIG. 1 is a schematic cross sectional view showing a simplified configuration of a fuser unit 20 as an embodiment of the invention.

FIG. 1 is a schematic sectional view showing a simplified configuration of a fuser unit 20 as an embodiment of the invention.

As shown in FIG. 1, the fuser unit 20 includes a set of a heat roller 21 and a pressure roller 22, a web sheet 23 as a band-shaped cleaning member provided so as to be in contact with the heat roller 21 and for cleaning a surface of the heat roller 21, a press roller 24 provided for pressing the web sheet 23 against the surface of the heat roller 21, a feed roller 25 around which the web sheet 23 is wound and which sequentially feeds the wound web sheet 23 from the tip of the web sheet 23, and a wind roller 26 for winding the web sheet 23 which is fed from the feed roller 25 and with which the surface of the heat roller 21 is cleaned.

The fuser unit 20 includes a heater 28 as a heat source provided for the axis of the heat roller 21 and supplying heat to the surface of the heat roller 21. Although not shown, the fuser unit 20 includes a heater control power source for supplying power to the heater 28, a temperature sensor for detecting the temperature of the surface of the heat roller 21, a pressing mechanism for pressing the pressure roller 22 against the heat roller 21, and a driving mechanism for rotating the heat roller 21 and the pressure roller 22. The configuration is similar to that of a known fuser unit.

The fuser unit 20 is mounted on, for example, an electrophotographic image forming apparatus. By making a recording medium having a surface on which an image visualized by unfused toner guided to and pass through a nip portion 29 between the heat roller 21 and the pressure roller 22, the unfused toner is fused and fixed on the recording medium.

In FIG. 1, the web sheet 23, feed roller 25, press roller 24, and wind roller 26 construct a cleaning unit 30 as a cleaning mechanism.

The web sheet 23 is a band-shaped windable/unwindable long member and has a structure capable of impregnating (sucking) toner adhered in a fused state to the surface of the heat roller 21 into an air layer and/or an air space as a small space. The web sheet 23 having heat resistance property at a temperature of about 200° C. as a fixing temperature is used and, for example, Nomex paper (trade name) and the like is suitable. The web sheet 23 is preliminarily impregnated with oil such as silicone oil to improve the heat resistance property and toner releasability.

The press roller 24 includes a roller core 31 and a cylindrical roller elastic member 32 provided around the roller core 31. The roller core 31 is a metal member having a circular column shape. Both ends of the roller core 31 are rotatably supported by the body of the fuser unit 20. The roller elastic member 32 is made of an expandable heat resisting material in the embodiment. Examples of the expandable heat resisting material are silicone rubber or urethane expanded rubber.

When the press roller 24 is pressed against the heat roller 21, a press contact area 33 (hereinbelow, called a nip portion 33) is formed between the press roller 24 and the heat roller 21 due to elastic deformation of the roller elastic member 32. The press roller 24 is provided so as to press the web sheet 23 interposed between the press roller 24 and the heat roller 21 against the surface of the heat roller 21 by not-shown press means so that the axis of the press roller 24 becomes parallel with that of the heat roller 21.

On the peripheral face of the roller elastic member 32 of the press roller 24, an oil absorption layer 27 for absorbing oil oozing out from the web sheet 23 may be provided.

Preferably, the oil absorption layer 27 is made of an oil absorbent material having an oil absorbable characteristic, particularly, paper. Although paper is preferably made of pulp, it may be made of synthetic fiber.

The press roller 24 is biased toward the core of the heat roller 21 by not-shown biasing means to press the web sheet 23 against the surface of the heat roller 21. As biasing means, for example, a coil spring is used. The press roller 24 is not provided with a driving mechanism and rotates as the web sheet 23 is wound. As the details will be described later, a reverse rotation preventing mechanism (first reverse rotation preventing mechanism) for preventing rotation of the web sheet 23 from rotating in the opposite direction to the winding direction is provided, and the press roller 24 is allowed to rotate only in one direction.

The web sheet 23 is pressed against the surface of the heat roller 21 by the press roller 24 to clean the toner adhered to the surface of the heat roller 21.

The feed roller 25 is a reel member around which the web sheet 23 of predetermined length is wound. The material of the roller may be a metal material such as aluminum but is not limited to the metal material. For example, a heat-resistant resin material may be used. The feed roller 25 is driven reverse-rotatably and rotation-speed-controllably by a feed roller driving unit which is not shown in FIG. 1. The wind roller 26 is a reel member similar to the feed roller 25. The material of the wind roller 26 may be a metal material such as aluminum but is not limited to the metal material. For example, a heat-resistant resin material may be used.

The wind roller 26 winds the web sheet 23 which is fed from the feed roller 25 and has cleaned toner by being pressed against the heat roller 21 by the press roller 24. The wind roller 26 is connected to a wind roller driving unit which is not shown in FIG. 1. The wind roller 26 is driven reverse-rotatably and rotation-speed-controllably by the feed roller driving unit. A drive source of the feed roller 25 and that of the wind roller 26 may be different from each other or a common drive source may be used. Specifically, the feed roller driving unit may use a not-shown web sheet wind motor as a driving source. With the configuration, the wind roller driving unit transmits power from the driving source to the wind roller 26, and the feed roller driving unit transmits power from the driving source to the feed roller 25.

One end of the web sheet 23 is wound around the feed roller 25, and the other end passes through the nip portion 33, is wound around the wind roller 26, and attached to the fuser unit 20. The web sheet 23 mounted in such a state cleans the heat roller 21 in a portion where the web sheet 23 is pressed against the heat roller 21. Specifically, when the heat roller 21 rotates, the surface of the heat roller 21 and the web sheet 23 in a stationary state slide each other. The surface of the heat roller 21 is cleaned in the sliding part in the web sheet 23. The travel speed of the peripheral surface of the heat roller 21 is, for example, 600 mm/sec.

When the web sheet wind motor stops, the winding operation of the wind roller 26 also stops. The web sheet 23 stops in a state where tension is applied. With the heat roller 21, a new part in the web sheet 23 is in contact. The heat roller 21 is cleaned by the new contact part in the web sheet 23, particularly, on the upstream side in the travel direction of the peripheral face of the heat roller 21.

Further, in this state, when a predetermined number of recording sheets pass through the nip portion 29, the microcomputer executes a new winding operation. The web sheet 23 is wound by the wind roller 26 only by a length according to the angle. In the use state, for example, the predetermined number is five to seven, and the length of the web sheet 23 wound by a single winding operation is 0.5 to 0.7 mm. It is preferable to wind the web sheet 23 only by a length corresponding to the width of the nip portion 33 just before the surface temperature of the heat roller 21 drops to about room temperature due to interruption of current passage to the heater 28. That is, when the power source of an image forming apparatus 50 is interrupted or the mode shifts to a power saving mode, it is preferable to execute the winding operation so as to supply a new part in the web sheet 23 to the whole region of the nip portion 33 before the surface temperature of the heat roller 21 drops.

By the operation, when the heat roller 21 rotates during subsequent warm-up time, a situation can be prevented such that toner hardened at low temperature exists in the nip portion 33 and the surface of the heat roller 21 is damaged by the toner. The width of the nip portion 33 is, for example, 3 to 4 mm.

As described above, by the intermittent winding operation of the web sheet 23, deterioration in the cleaning capability of the cleaning mechanism 30 is suppressed. By repeating the winding operation to the end of the web sheet 23, the cleaning capability is maintained for long time.

Reverse Rotation Preventing Mechanism

Figure 2A:
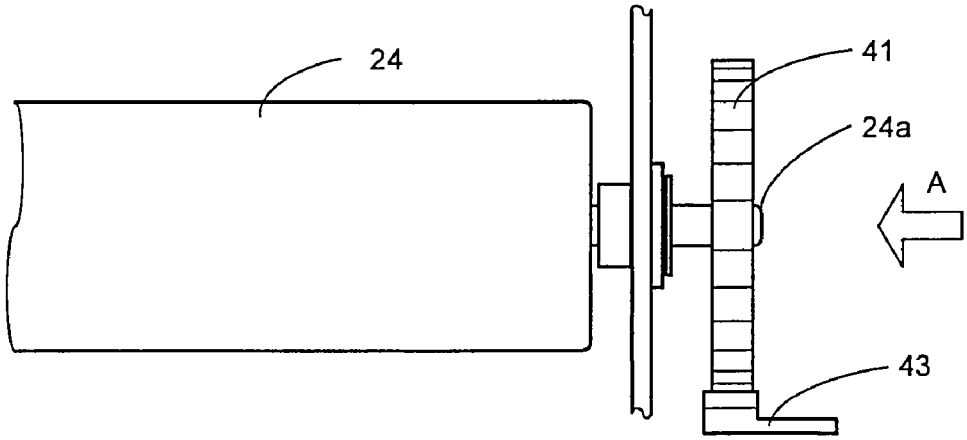
FIGS. 2A and 2B are diagrams illustrating an example of a first reverse rotation preventing mechanism provided for a driving unit of a press roller 24 as an embodiment of the invention.
Figure 2B:
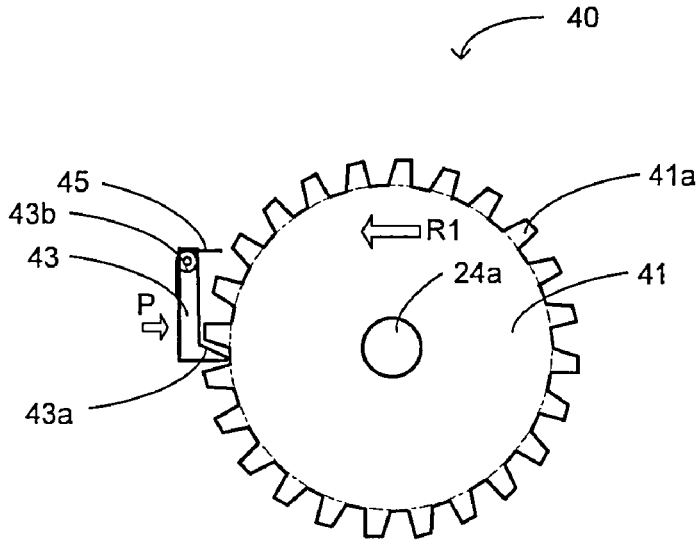

FIGS. 2A and 2B are diagrams showing an example of the reverse rotation preventing mechanism provided for the driving unit in the press roller 24 as an embodiment of the invention. FIG. 2A is a plan view showing the structure of an end part of the press roller. FIG. 2B is a side view of a ratchet mechanism seen from the direction of the arrow A in FIG. 2A. As shown in FIG. 2A, a ratchet gear 41 as a latch of the ratchet mechanism is attached to one end of a press roller shaft 24*a*. A gear 41*a* is formed in the periphery of the ratchet gear 41. A nail member 43 is disposed so as to be in contact with the gear 41*a*. A helical torsion coil spring 45 is attached to a fulcrum 43*b* of the nail member 43, and nails 43*a* of the nail member 43 are biased so as to come into contact with the gear 41*a*.

An arrow P in FIG. 2B shows the direction of biasing the nails 43*a*. By a ratchet mechanism 40 formed by the ratchet gear 41 and the nail member 43, the ratchet gear 41 can rotate only in one direction of an arrow R1. The press roller 24 integrated with the ratchet gear can also rotate only in the same one direction. As described above, the press roller 24 is a driven roller which rotates as the web sheet 23 is wound, and the arrow R1 is the direction of rotation accompanying the winding operation of the web sheet 23. That is, the arrow R1 shows the direction opposite to the travel of the peripheral face of the heat roller 21.

A frictional force in the direction of travel of the peripheral face is received by a part which comes into contact with the heat roller 21 in the web sheet 23 when the heat roller 21 rotates. Since the press roller 24 which comes into contact with the back face of the web sheet 23 has the reverse rotation preventing mechanism, even if the web sheet 23 travels in the opposite direction to the winding direction due to the frictional force from the heat roller 21, the travel is prevented by a static friction force of the press roller 24 and tension of the wind roller 26 side. Therefore, toner accumulated on the upstream side of the nip portion 33 stays between the heat roller 21 and the web sheet 23 without entering the nip portion 33.

Preferably, the wind roller 26 has a reverse rotation preventing mechanism (second reverse rotation preventing mechanism) for preventing rotation from rotating in the opposite direction to the winding direction. By the mechanism, tension in the winding direction to the web sheet 23 is maintained when the winding operation is not performed. The reverse rotation preventing mechanism of the wind roller 26 can be realized by a ratchet mechanism like the above-described reverse rotation preventing mechanism 40.

Figure 3A:
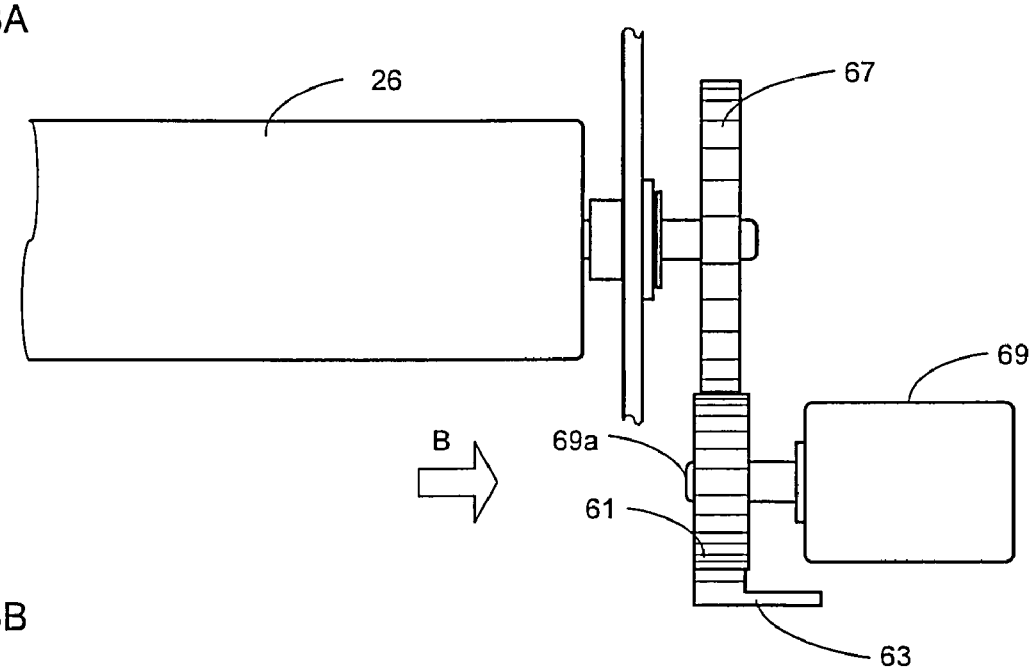
FIGS. 3A and 3B are diagrams illustrating an example of providing a second reverse rotation preventing mechanism for a driving unit in a wind roller 26 as another embodiment of the invention.
Figure 3B:
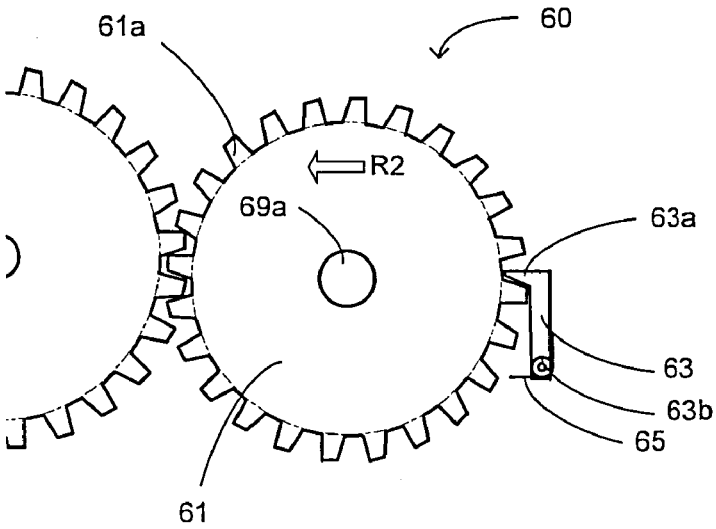

FIGS. 3A and 3B are diagrams showing an example of providing the driving unit in the wind roller 26 with a second reverse rotation preventing mechanism 60 as another embodiment of the invention. In FIG. 3A, a wind roller drive gear 67 is attached to the axis of the wind roller 26 and driven integrally with the wind roller 26. The drive source of the wind roller 26 is a web sheet winding drive motor 69. To a motor output shaft 69*a* of the web sheet winding drive motor 69, a ratchet gear 61 is integrally attached. A gear 61*a* is formed in the periphery of the ratchet gear 61. The gear 61*a* engages with the wind roller drive gear 67 and drives the wind roller 26. Further, nails 63*a* of a nail member 63 of the ratchet mechanism are in contact with the gear 61*a*, and prevent rotation in the opposite direction to the winding direction. The nail member 63 is biased by a helical torsion coil spring 65 disposed at a fulcrum 63*b* so as to function as a ratchet mechanism with the nails 63*a* in contact with the gear 61*a*.

In the ratchet mechanism of FIGS. 3A and 3B, the gear 61*a* has both of the function of a latch and the function of transmitting drive to the wind roller 26. The gear is not limited to such a mode. A gear for transmitting drive and a latch may be gears independent of each other and coaxially integrated as a two-stage gear. The nail member 63 may be in contact with a wind roller drive gear 67, not the motor output shaft 69*a*.

In the above description, both of the reverse rotation preventing mechanisms use ratchet mechanisms. The present invention is not limited to the configuration of the reverse rotation preventing mechanism. For example, a known one-way clutch may be used. If the roller is rotatable only in one way, the structure is not limited.

Figure 9A:
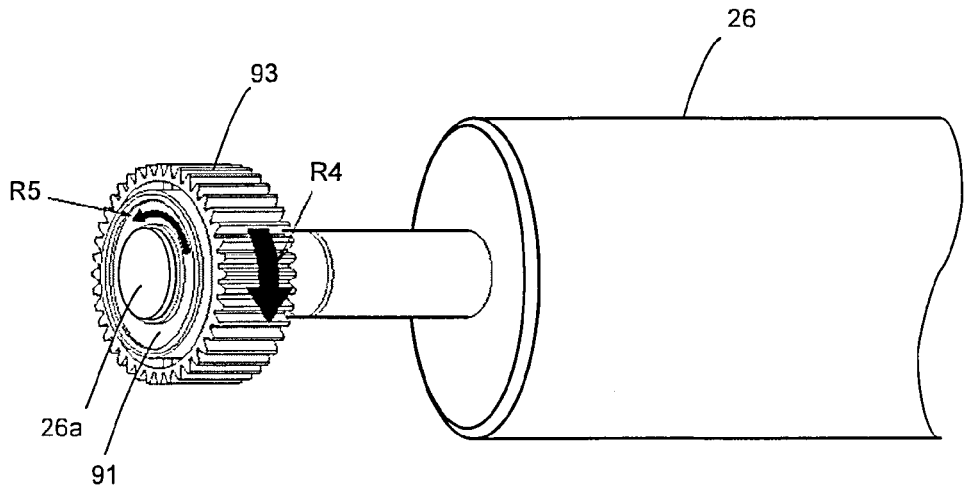
FIGS. 9A and 9B are diagrams showing an example using a one-way clutch for the reverse rotation preventing mechanism of the fuser unit of the invention.
Figure 9B:
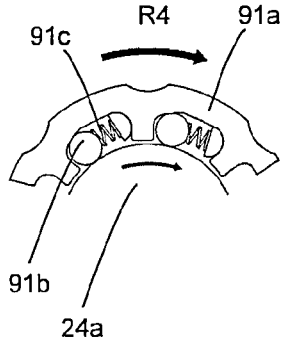

FIGS. 9A to 9B are explanatory diagrams showing an example using a one-way clutch as the reverse rotation preventing mechanism according to the invention. In FIG. 9A, a one-way clutch 91 is attached to an end of a wind roller shaft 26*a* of the wind roller 26. Drive from the web sheet wind drive motor which is not shown in FIG. 9A is transmitted via a not-shown transmitting mechanism to a wind roller drive gear 93 attached to the periphery of the one-way clutch 91. By the drive, the wind roller drive gear 93 rotates in the direction shown by the arrow R4. The rotation of the wind roller drive gear 93 is transmitted to the wind roller shaft 26*a* of the wind roller 26 via the one-way clutch 91. When the wind roller drive gear 93 rotates in the direction of the arrow R4, the wind roller shaft 26*a* rotates in the same direction. On the other hand, in a state where the wind roller drive gear 93 is stationary, the wind roller 26 is rotatable in the direction of the arrow R4 but does not rotate in the opposite direction (the direction of an arrow R5). This is because of the action of the one-way clutch 91. The direction shown by the arrow R4 is the direction of winding the web sheet 23.

Figure 9C:
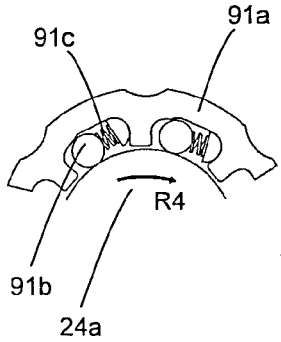

FIGS. 9B and 9C are cross sections showing an example of an internal structure of the one-way clutch 91. The one-way clutch in FIGS. 9B and 9C is constructed by an outer ring 91*a* rotatably fit in the outer periphery of the wind roller shaft 26*a*, and a roller 91*b* and a spring 91*c* housed in a recess formed in an inner circumference part of the outer ring 91*a*. The outer ring 91*a* rotates integrally with the wind roller drive gear 93. FIG. 9B shows the case where the outer ring 91*a* rotates in the direction of the arrow R4. When the outer ring rotates in the direction of the arrow R4, by the action of the spring 91*c*, the roller 91*b* advances to an engagement position of a recess formed in the inner circumference part of the outer ring 91*a*. By a wedge action between the inner face of the recess and the outer peripheral face of the wind roller shaft 26*a*, rotation is transmitted to the wind roller shaft 26*a*. FIG. 9B shows the case where the outer ring 91*a* is stationary and the wind roller shaft 26*a* rotates in the direction of the arrow R4. When the wind roller shaft 26*a* rotates in the direction of R4, the roller 91*b* becomes apart from the inner face of the outer ring 91*a*, and the wind roller shaft 26*a* runs at idle in the outer ring 91*a*. The outer ring 91*a* maintains a stationary state.

The above description relates to the case using the one-way clutch as the reverse rotation preventing mechanism of the wind roller 26. Next, the case using a one-way clutch as the reverse rotation preventing mechanism of the press roller 24 will be described. As described above, the press roller is not provided with a drive mechanism and just rotates as the web sheet 23 is wound. Consequently, it is sufficient to attach a one-way clutch to an end of the press roller shaft 24*a* and fix the outer ring of the one-way clutch to a frame. In such a manner, the press roller 24 rotates only in the direction of winding the web sheet 23 but does not rotate in the opposite direction.

Figure 4A:
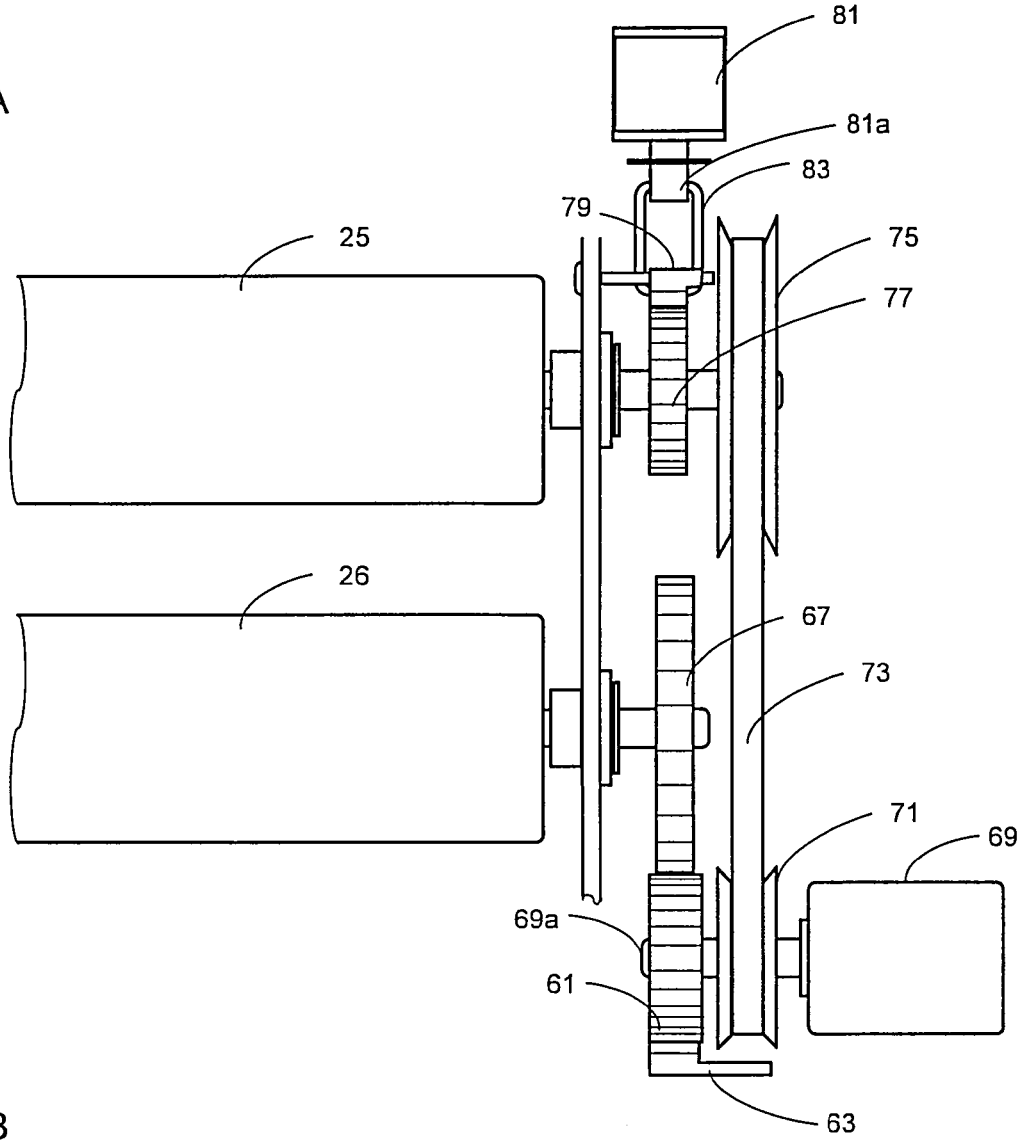
FIGS. 4A and 4B are diagrams illustrating the configuration in which a rotation preventing mechanism is provided for a driving unit in a feed roller 25 as further another embodiment of the invention.
Figure 4B:
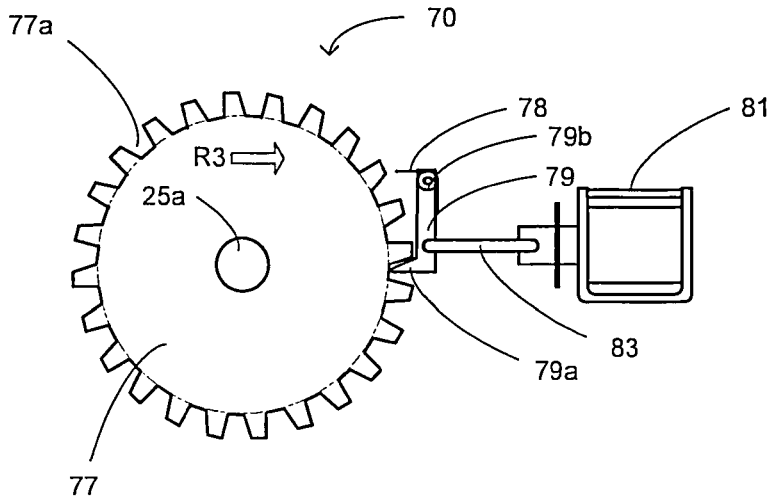

Further, the feed roller drive unit of the cleaning mechanism 30 may have a rotation preventing mechanism which can be disengaged. FIGS. 4A and 4B show further another embodiment of the invention in which the drive unit of the feed roller 25 is provided with a rotation preventing mechanism. In FIGS. 4A and 4B, to the motor output shaft 69*a* of the web sheet winding drive motor 69, not only the ratchet gear 61 for transmitting the drive force to the wind roller 26 but also a feed roller driving pulley 71 for transmitting a drive force to the feed roller are integrally attached. The feed roller driving pulley 71 transmits the driving force to the feed roller driving pulley 75 via a drive belt 73.

The feed roller driving pulley 75 is attached integrally with a feed roller shaft 25*a* of the feed roller 25. Further, to the feed roller shaft 25*a*, a ratchet gear 77 as a rotation preventing mechanism is integrally attached. A gear 77*a* is formed in the periphery of the ratchet gear 77. Nails 79*a* of a nail member 79 are biased so as to come into contact with the gear 77*a* by a helical torsion coil spring 78 attached to an area of a fulcrum 79*b* of the nail member 79. The helical torsion coil spring 78 corresponds to biasing means in the claims. Further, the nail member 79 is attached to a plunger 81*a* of a ratchet disengagement solenoid 81 for disengaging the ratchet via a link member 83. The ratchet disengagement solenoid 81 corresponds to nail member driving means in the claims. The rotation preventing mechanism in the feed roller driving unit prevents rotation of the feed roller 25 from rotating in the winding direction.

In the winding operation, the microcomputer passes current to the ratchet disengagement solenoid 81 to disengage the ratchet and, after that, rotates the web sheet winding drive motor 69 to wind the web sheet 23. After the winding operation is finished and the web sheet winding drive motor 69 stops, the microcomputer stops passing current to the ratchet disengagement solenoid 81. In such a manner, the rotation in the winding direction of the feed roller 25 is prevented except when the operation of winding the web sheet 23 is performed. Therefore, the web sheet 23 is maintained in a state where tension is applied from the feed roller side, so that the web sheet 23 can be prevented from being fed uselessly.

The feed roller driving pulley B 75 may rotate at slow speed so as to give proper back tension to the web sheet 23. In this case, when the feed roller 25 rotates at a tension of winding the web sheet 23, a slip occurs between the drive belt 73 and the feed roller drive pulley A 71 and/or the feed roller drive pulley B 75, and back tension occurs. The slip functions as a speed regulating mechanism for regulating the ratio of rotation speeds of the rollers in accordance with the ratio of the radius of the web sheet 23 wound around the feed roller 25 and the radius of the web sheet 23 wound around the wind roller 26.

The rotation preventing mechanism of the feed roller is particularly effective in the case where a paper jam occurs in a state where a recording sheet stays in the nip portion 29. To remove the recording sheet staying in the nip portion 29, the user pulls the tip of the exposed sheet. In the case where the pulling direction is opposite to the direction of conveyance of the recording sheet, that is, when the sheet is pulled out to the transfer part side, the heat roller rotates in the direction opposite to that during printing. As a result, the web sheet 23 undergoes the force in the winding direction. When the rotation preventing mechanism is provided to the feed roller, the rotation of the feed roller 25 is prevented and the web sheet 23 receives the tension from the feed roller side. As a result, the web sheet 23 is not fed uselessly.

Figure 6:
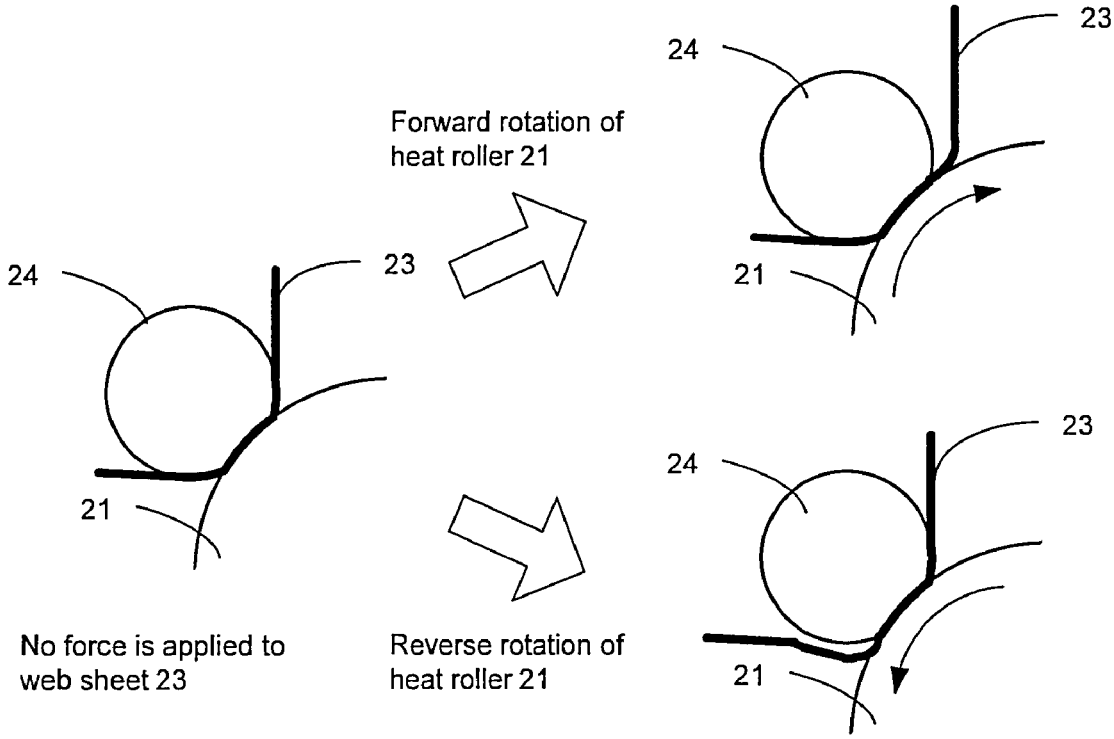
FIG. 6 is a diagram showing a state where a frictional force from a heat roller 21 is received by a web sheet 23 in a nip portion 33 and, as a result, a small "slack" occurs in the fuser unit of the embodiment.

FIG. 6 is a diagram showing a state where the web sheet 23 in the nip portion 33 undergoes the frictional force from the heat roller 21 in the fuser unit of the embodiment and, as a result, slight "slackness" occurs. According to the present invention, however, the press roller 24 has the reverse rotation preventing mechanism. Consequently, the web sheet 23 is prevented from being largely deviated as the heat roller 21 rotates.

That is, even when a force in the opposite direction to the direction of winding the web sheet 23 is received as the heat roller 21 rotates, the press roller 24 does not rotate reversely. Further, when the wind roller 26 does not rotate reversely, travel of the web sheet 23 is suppressed by the tension from the wind roller side. Therefore, although slight "slackness" occurs on the downstream side of the nip portion 33 in the direction of movement of the peripheral face of the heat roller 21, the web sheet 23 is not largely deviated and toner accumulated at the upstream end of the nip portion 33 is prevented from entering the nip portion 33. Further, when the feed roller 25 is provided with the rotation preventing mechanism, even if the heat roller rotates reversely at the time of solving a paper jam, useless feeding of the web sheet 23 is prevented.

Figure 10A:
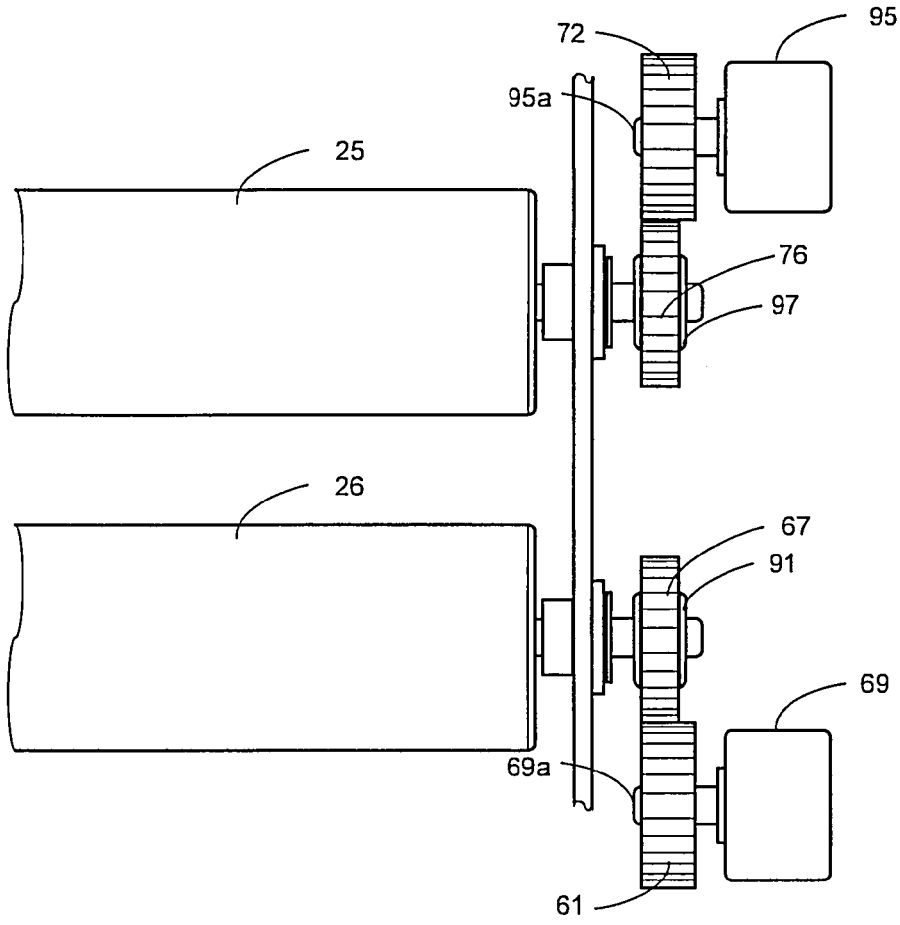
FIGS. 10A and 10B are diagrams showing an example using a one-way clutch for each of a reverse rotation preventing mechanism for the wind roller and a rotation preventing mechanism for a feed roller of the invention.
Figure 10B:
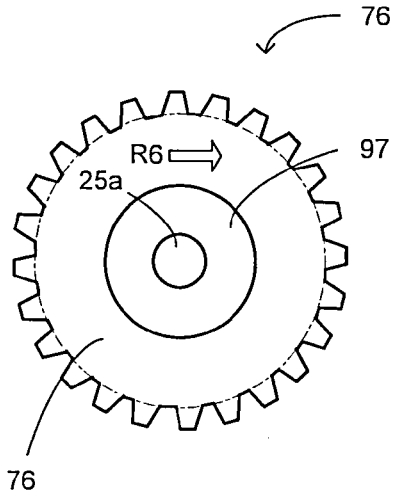

FIGS. 10A and 10B are diagrams showing an example of using a one-way clutch as each of the reverse rotation preventing mechanism for the wind roller and the rotation preventing mechanism for the feed roller. In FIG. 10A, the drive source of the wind roller 26 is the web sheet winding drive motor 69. The web sheet winding drive motor 69 is a stepping motor. The driving of the motor is transmitted from the wind roller drive gear A61 attached to the motor output shaft 69*a* to the wind roller drive gear B67 which engages with the wind roller drive gear A61. The wind roller drive gear B67 rotates integrally with the outer ring 91*a* of the one-way clutch 91. When the wind roller drive gear B67 rotates in the direction of winding the web sheet 23, the one-way clutch 91 transmits the drive to the wind roller shaft 26*a*.

In FIG. 10A, the drive source of the feed roller 25 is a feed drive motor 95. The feed drive motor 95 is a stepping motor. The driving of the motor is transmitted from the feed roller drive gear A72 attached to a motor output shaft 95*a* to a feed roller drive gear B76 which engages with the feed roller drive gear A72. The feed roller drive gear B76 rotates integrally with an outer ring 97*a* of the one-way clutch 97. When the feed roller drive gear B76 is stationary, the one-way clutch 97 prevents rotation of the feed roller 25 from rotating in the feeding direction of the web sheet 23. On the other hand, when the feed roller drive gear B76 rotates in the direction of feeding the web sheet 23, rotation of the feed roller shaft 25*a* with the feed roller drive gear B76 is allowed by tension from the web sheet 23.

FIG. 10B is a diagram showing a state where the feed roller drive gear B76 is viewed from a position on an extension line of the feed roller shaft 25*a*. The feed roller drive gear B76, the one-way clutch 97 on the inside of the feed roller drive gear B76, and the feed roller shaft 25*a* in the center of the feed roller drive gear B76 are arranged coaxially so that their centers match each other. The direction of winding the web sheet 23 is shown by an arrow R6. The one-way clutch 97 prevents rotation of the feed roller shaft 25*a* from rotating in the direction shown by the arrow R6 when the feed roller drive gear B76 is in a stationary state.

The web sheet winding drive motor 69 and the feed drive motor 95 are controlled by the not-shown microcomputer. The microcomputer rotates the motors to wind the web sheet 23 at a predetermined timing. At this time, according to the wind amount of the web sheet 23, the rotation speeds of the wind roller 26 and the feed roller 25 are controlled. When the web sheet 23 is not wound, the microcomputer may control so as to statically excite the motors.

Figure 7:
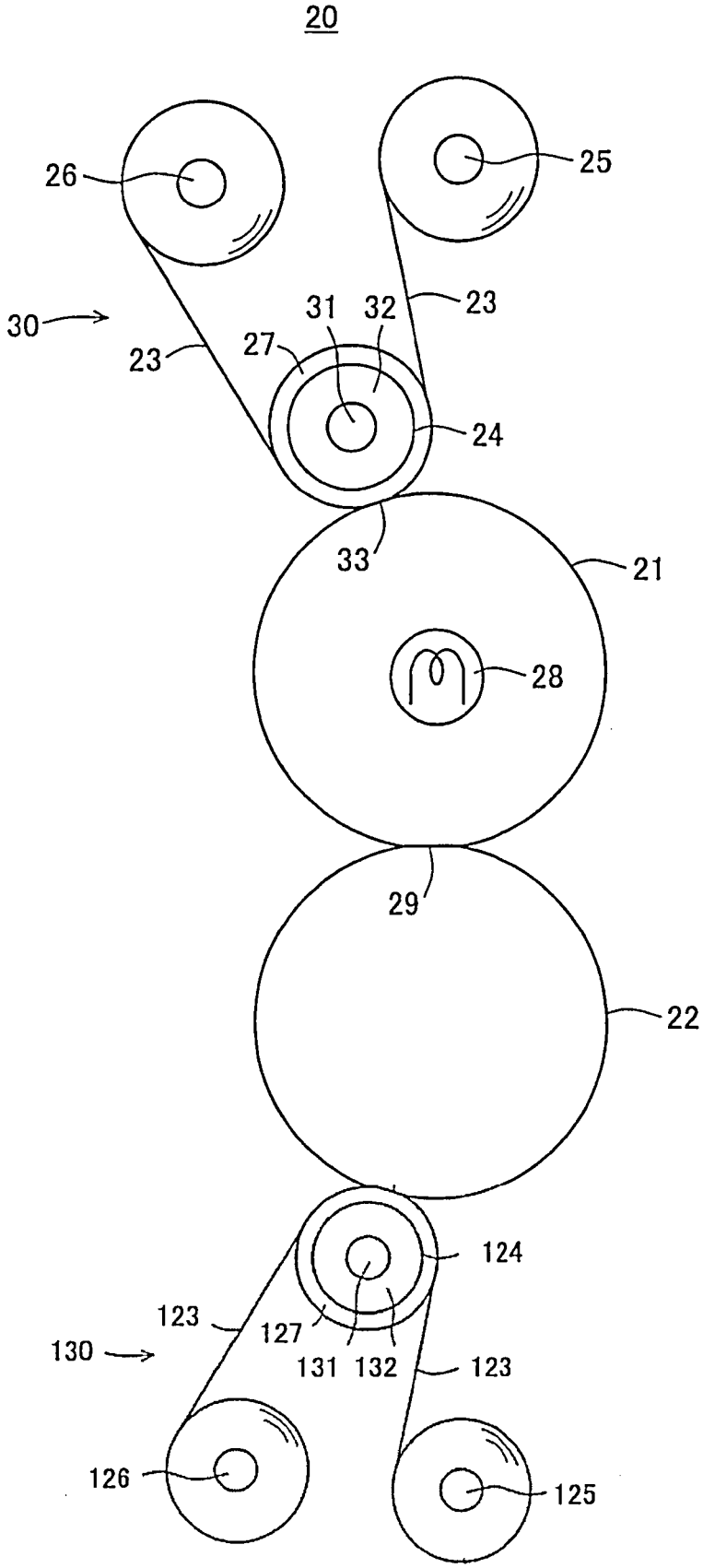
FIG. 7 is a diagram showing an example of the fuser unit 20 provided with a press roller cleaning mechanism 130 in addition to a cleaning mechanism 30 of a heat roller 21 as further another embodiment of the invention.
Figure 8:
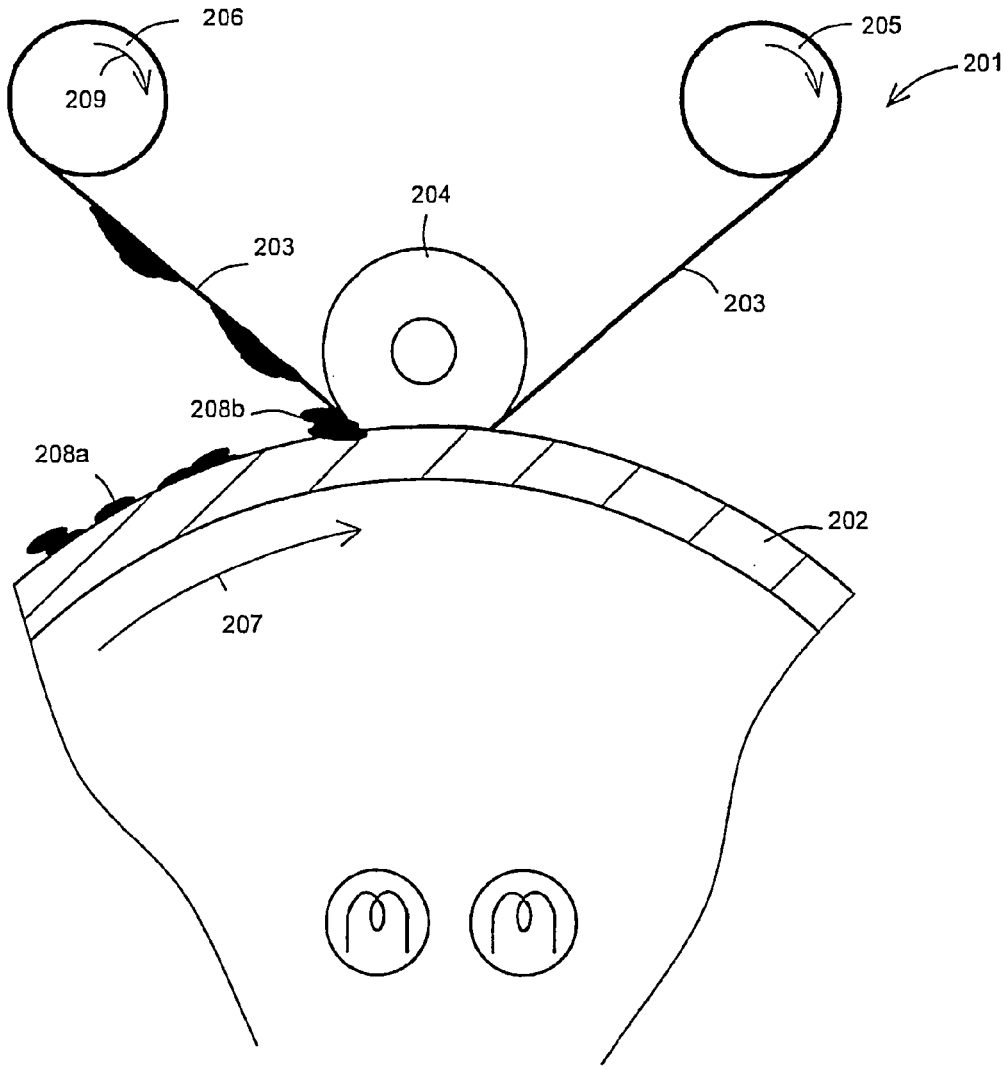
Fig.8 CONVENTIONAL ART
FIG. 8 is a diagram showing a schematic configuration of a fuser cleaning mechanism 201 of a conventional web cleaning system.

Although the case where the cleaning mechanism 30 is provided for the heat roller 21 has been described above, a similar cleaning mechanism 30 may be provided around the pressure roller 22 to clean a surface of the pressure roller 22. Alternately, cleaning mechanisms 30 may be provided for both of the heat roller 21 and the pressure roller 22. FIG. 7 shows further another embodiment of the invention in which the fuser unit 20 is provided with the cleaning mechanism 30 for the heat roller 21 and, in addition, a cleaning mechanism 130 for the pressure roller. The cleaning mechanism 130 for the pressure roller includes a web sheet 123 of the pressure roller, a press roller 124, a feed roller 125, and a wind roller 126. The press roller 124 is constructed by an oil absorption layer 127, a roller core 131, and a roller elastic member 132.

Configuration Example of Image Forming Apparatus

Figure 5:
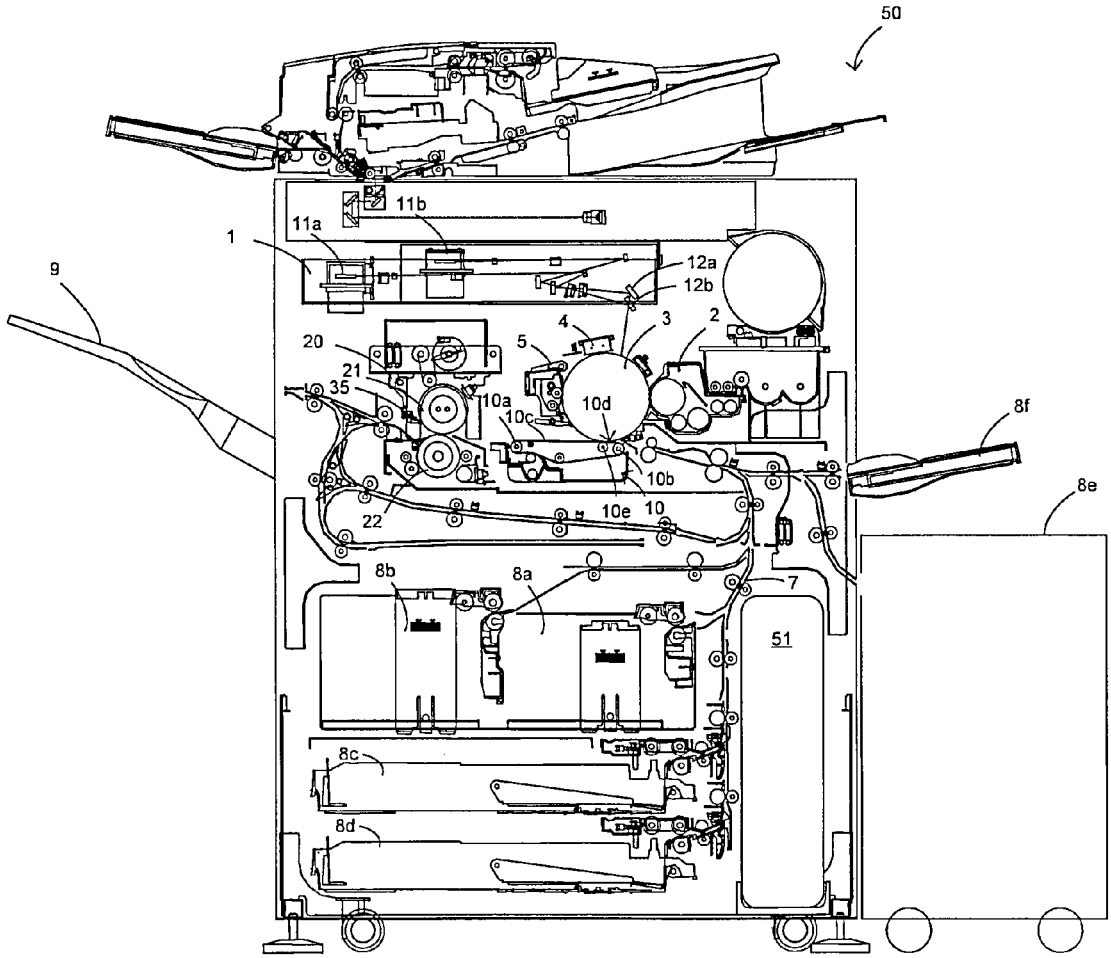
FIG. 5 is a diagram showing the configuration of an image forming apparatus according to an embodiment of the invention.

FIG. 5 is a diagram showing the configuration of an image forming apparatus of an embodiment of the present invention.

The image forming apparatus 50 forms a monochrome image on a predetermined recording sheet (sheet) in accordance with image data transmitted from the outside. As shown in the diagram, the image forming apparatus 50 includes an exposure unit 1, a developing unit 2, a photoconductor drum 3, a charging unit 4, a cleaner unit 5, the fuser unit 20, a sheet conveyance path 7, paper feeding trays 8*a* to 8*d*, and a sheet exit tray 9.

The charging unit 4 is charging means for uniformly charging a surface of the photoconductor drum 3 to a predetermined potential, and the charging unit 4 of a corona charging type is used as shown in FIG. 5. Alternatively, a charging unit of a contact roller type or a brush type may be used.

As the exposure unit 1, a laser scanning unit (LSU) having laser irradiators 11*a* and 11*b* and reflecting mirrors 12*a* and 12*b* is used as shown in FIG. 5. Other than the method, for example, a method using an EL or LED write head in which light emitting elements are arranged in an array may be used. The apparatus employs a two-beam method of using a plurality of laser beams to perform a higher-speed printing process and suppressing increase in the speed of irradiation timings. The exposure unit 1 performs exposing operation in accordance with image data input to the photoconductor drum 3 uniformly charged by the charging unit 4, thereby forming an electrostatic latent image according to the image data on the surface of the photoconductor drum 3.

The developing unit 2 makes the electrostatic latent image formed on the photoconductor drum 3 visible with black toner.

The cleaner unit 5 removes and collects toner residing on the surface of the photoconductor drum 3 after the development and transfer of the image. The collected toner (waste toner) passes through a not-shown waste toner conveyance path on the back side of the image forming apparatus 50 and is housed in a waste toner vessel 52.

The image forming apparatus 50 includes a not-shown control board functioning as a control unit. The control board includes a microcomputer, a ROM, a RAM, a nonvolatile memory, an input circuit, and an output circuit. The ROM stores a control program executed by the microcomputer. The RAM provides a work area for the microcomputer. The nonvolatile memory holds control data. The input circuit is a circuit to which signals from detecting means in the components in the image forming apparatus 50 are input. An example of the detecting means is a paper jam sensor provided in the sheet conveyance path 7 and for detecting a paper jam. The output circuit is a circuit for driving loads such as an actuator and a motor for operating the components in the image forming apparatus. The motor is, for example, a not-shown fuser unit driving motor for driving the fuser unit 20. An example of the load is a heater for heating the fuser roller in the fuser unit 20.

The electrostatic latent image formed on the photoconductor drum 3 is made visible with charging toner by the developing unit 2. That is, a toner image is formed on the photoconductor drum 3. The toner image is transferred onto a sheet by a transfer mechanism 10 (in the apparatus, a transfer belt unit). The transfer mechanism 10 applies a voltage of the polarity of attracting the charged toner to the transfer belt on the sheet back side. The toner image on the photoconductor drum 3 is transferred onto a sheet. For example, when a toner image has charges of the negative (−) polarity, the voltage applied to the transfer belt is a voltage of the (+) polarity.

In the transfer mechanism 10 of the apparatus, a transfer belt 10*c* looped over a transfer belt drive roller 10*a*, a transfer belt driven roller 10*b*, and other rollers and having a predetermined resistance value (in the range of $1\times10^{9}$ to $1\times10^{13}$ Ω·cm) is disposed. Further, an elastic conductive roller 10*e* capable of applying a transfer electric field with conductivity different from that of the driving and driven rollers to a contact part 10*d* between the photoconductor drum 3 and the transfer belt 10*c* is disposed. An electrostatic image (unfixed toner) transferred on the sheet by the transfer mechanism 10 is conveyed to the fuser unit 20.

The fuser unit 20 corresponds to the fuser unit 20 in FIG. 1, and has the heat roller 21 and the pressure roller 22. On the periphery of the heat roller 21, the cleaning member 30 and a sheet peeling nail 35 are disposed. Further, although not shown, a roller surface temperature detecting member (thermister) is disposed. On the inner side of the heat roller 21, the heater 28 for heating the surface of the heat roller to predetermined temperature (fusing set temperature: approximately 160 to 200° C.) is disposed. On the other hand, a not-shown pressing member is disposed at each of both ends of the pressure roller 22.

The paper feeding trays 8*a* to 8*d* are trays for storing sheets used for image formation. In the apparatus, the paper feeding trays 8*a* to 8*d* are provided below an image forming unit and on a side wall face. In the apparatus, to perform high-speed printing process, a large amount of sheets can be stored. Specifically, 1,500 sheets can be housed in each of the paper feeding trays 8*a* and 8*b* disposed below the image forming unit, and 500 sheets can be housed in each of the paper feeding trays 8*c* and 8*d* disposed below the paper feeding trays 8*a* and 8*b*, respectively. On the side face of the apparatus, a large-amount sheet feeding cassette 8*e* capable of housing sheets more than the sheets in the paper feeding tray 8 and a manual sheet feeding tray 8*f* mainly used for printing on various kinds of sheets and a sheet of an odd size are disposed.

The sheet exit tray 9 is disposed on the side opposite to the manual sheet feeding tray 8*f* of the apparatus. In place of the sheet exit tray 9, a post-process apparatus (for performing a stapling process, a punching process, and the like on an ejected sheet) and a multiple-stage sheet exit tray may be disposed as an option.

Finally, the invention is not limited to the foregoing embodiments but obviously can be variously modified without departing from the characteristics and the range of the invention. All changes that fall within the meaning and range of equivalency of the claims are intended to be embraced by the scope of the invention.

What is claimed is:

1. A fuser unit with a cleaning mechanism, comprising:

a set of a heat roller and a pressure roller for sandwiching a recording sheet while heating the recording sheet by the heat roller;

a feed roller for feeding a band-shaped cleaning member which is windable;

a press roller for pressing the fed cleaning member against a surface of the heat roller or the pressure roller;

a wind roller for winding the cleaning member which is pressed by the press roller;

a first reverse rotation preventing mechanism for preventing rotation of the press roller from rotating in the opposite direction to the winding direction of the cleaning member;

a second reverse rotation preventing mechanism for preventing rotation of the wind roller from rotating in the opposite direction to the winding direction of the cleaning member; and a rotation preventing mechanism, wherein the feed roller feeds the cleaning member intermittently, and the rotation preventing mechanism includes a disengaging mechanism to prevent the feed roller from rotating in the feeding direction when the cleaning member is not wound, and to allow the feed roller to rotate in the feeding direction when the cleaning member is wound.

2. The fuser unit according to claim 1, wherein the first reverse rotation preventing mechanism is a ratchet mechanism including a ratchet gear which is directly or indirectly coupled to a shaft of the press roller.

3. The fuser unit according to claim 1, wherein the first reverse rotation preventing mechanism is a one-way clutch which is directly or indirectly coupled to the shaft of the press roller.

4. The fuser unit according to claim 1, wherein the second reverse rotation preventing mechanism is a ratchet mechanism including a ratchet gear which is directly or indirectly coupled to a shaft of the wind roller.

5. The fuser unit according to claim 1, wherein the second reverse rotation preventing mechanism is a one-way clutch disposed between the wind roller and a drive source thereof.

6. The fuser unit according to claim 1, wherein the rotation preventing mechanism is a disengageable ratchet mechanism including a ratchet gear which is directly or indirectly coupled to a shaft of the feed roller, a nail member which can engage with the gear, and a disengaging mechanism for engaging/disengaging the nail member with/from the ratchet gear.

7. The fuser unit according to claim 6, wherein the disengaging mechanism includes biasing means for biasing the nail member so that it engages with the ratchet gear, and nail member driving means for making the nail member apart from the ratchet gear against biasing by the biasing means, and the nail member driving means drives the nail member to enable the wind roller to rotate in the winding direction while the cleaning member is wound.

8. The fuser unit according to claim 1, wherein the rotation preventing mechanism is a one-way clutch disposed between the feed roller and a drive source thereof.

9. An image forming apparatus comprising the fuser unit according to claim 1.

* * * * *